US008419353B2

(12) United States Patent
Hotta et al.

(10) Patent No.: US 8,419,353 B2
(45) Date of Patent: Apr. 16, 2013

(54) WATER PUMP

(75) Inventors: Takayuki Hotta, Chiryu (JP); Shuhei Yamazaki, Chita-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 1183 days.

(21) Appl. No.: 11/937,585

(22) Filed: Nov. 9, 2007

(65) Prior Publication Data

US 2008/0112792 A1 May 15, 2008

(30) Foreign Application Priority Data

Nov. 10, 2006 (JP) ..... 2006-304851

(51) Int. Cl.
*F04D 29/12* (2006.01)

(52) U.S. Cl.
USPC ..... 415/168.2

(58) Field of Classification Search ..... 415/111, 415/112, 168.1, 168.2
See application file for complete search history.

(56) References Cited

U.S. PATENT DOCUMENTS

| | | | | |
|---|---|---|---|---|
| 4,640,031 | A | 2/1987 | Hoek et al. | |
| 5,338,153 | A * | 8/1994 | Swanson et al. | 415/168.2 |
| 5,490,762 | A | 2/1996 | Feucht et al. | |
| 5,660,521 | A | 8/1997 | Serio | |
| 5,950,577 | A * | 9/1999 | Sasaki et al. | 123/41.44 |
| 6,270,312 | B1 * | 8/2001 | Heer | 415/111 |
| 6,638,015 | B2 * | 10/2003 | Ozawa et al. | 415/168.2 |
| 7,704,040 | B2 * | 4/2010 | Yamazaki et al. | 415/168.1 |

FOREIGN PATENT DOCUMENTS

| | | | |
|---|---|---|---|
| EP | 0428210 A1 | | 5/1991 |
| JP | 59-099200 A | | 6/1984 |
| JP | 59-99200 U | * | 7/1984 |
| JP | 11-336699 A | | 12/1999 |
| JP | 1999-336699 A | | 12/1999 |
| JP | 11336699 A | * | 12/1999 |
| JP | 2004-108250 A | | 4/2004 |

OTHER PUBLICATIONS

Extended European Search Report issued by European Patent Office on Jul. 30, 2010 in corresponding European Patent Application No. 07020510.9.

Japanese Office Action issued Sep. 13, 2011 in the corresponding Japanese Patent Application No. 2006-304851 and English-language translation.

* cited by examiner

*Primary Examiner* — Richard Edgar
(74) *Attorney, Agent, or Firm* — Buchanan Ingersoll & Rooney PC

(57) ABSTRACT

A water pump includes an impeller provided at a first end of a rotational shaft supported by a body via a bearing, a mechanical seal provided between the impeller and the bearing, a draining hole introducing a water drop leaked from an impeller side via the mechanical seal to a reservoir provided at a bottom of the body and having a side opening, a plugging member provided at the side opening of the reservoir for liquid-tightly sealing the reservoir, and an opening portion provided at the plugging member for communicating the reservoir and an atmosphere side.

6 Claims, 3 Drawing Sheets

WATER PUMP

CROSS REFERENCE TO RELATED APPLICATIONS

This application is based on and claims priority under 35 U.S.C. §119 with respect to Japanese Patent Application No. 2006-304851 filed on Nov. 10, 2006, the entire content of which is incorporated herein by reference.

FIELD OF THE INVENTION

The present invention relates to a water pump.

BACKGROUND

A known water pump applied to a water-cooled engine includes an impeller provided on an end of a rotational shaft supported by a body via a bearing, and cooling water is circulated in an engine by rotating the rotational shaft. A space is formed between the bearing and a mechanical seal which is provided between the impeller and the bearing. Vaporized cooling water infiltrates the space via the mechanical seal and is condensed into water drops, and the condensed water drops are drained through a draining hole to a reservoir provided at a bottom portion of the body. A groove which introduces the water drops leaked to the draining hole to the bottom of the reservoir is provided at a sidewall of the reservoir. Further, an annular groove is provided at a sidewall of the reservoir so that the leaked cooling water stored in the reservoir is not drained to the atmosphere side. (I.e., disclosed in JPH11-336699A)

According to another known water pump disclosed in JP2004-108250A, a stepped portion is provided between a vapor hole and an opening surface where the draining hole opens to the reservoir, so that the vapor hole positions above the opening surface, and draining of the water drops leaked from the draining hole to the atmosphere side via an upper surface of the vapor hole is prevented.

However, with the constructions of the water pump disclosed in JPH11-336699A and JP2004-108250A, there is a drawback that the leaked water stored in the reservoir rises upward because of capillary action at a minor gap between a plug which plugs an opening portion of the reservoir and a body to which the plug is press-fitted, so as to drain to the outside through the vapor hole.

A need thus exists for a water pump which is not susceptible to the drawback mentioned above.

SUMMARY OF THE INVENTION

In light of the foregoing, the present invention provides a water pump, which includes an impeller provided at a first end of a rotational shaft supported by a body via a bearing, a mechanical seal provided between the impeller and the bearing, a draining hole introducing a water drop leaked from an impeller side via the mechanical seal to a reservoir provided at a bottom of the body and having a side opening, a plugging member provided at the side opening of the reservoir for liquid-tightly sealing the reservoir, and an opening portion provided at the plugging member for communicating the reservoir and an atmosphere side.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Embodiments of the present invention will be explained with reference to illustrations of drawing figures as follows.

A first embodiment of the present invention will be explained referring to FIGS. 1-2.

Figure 1:
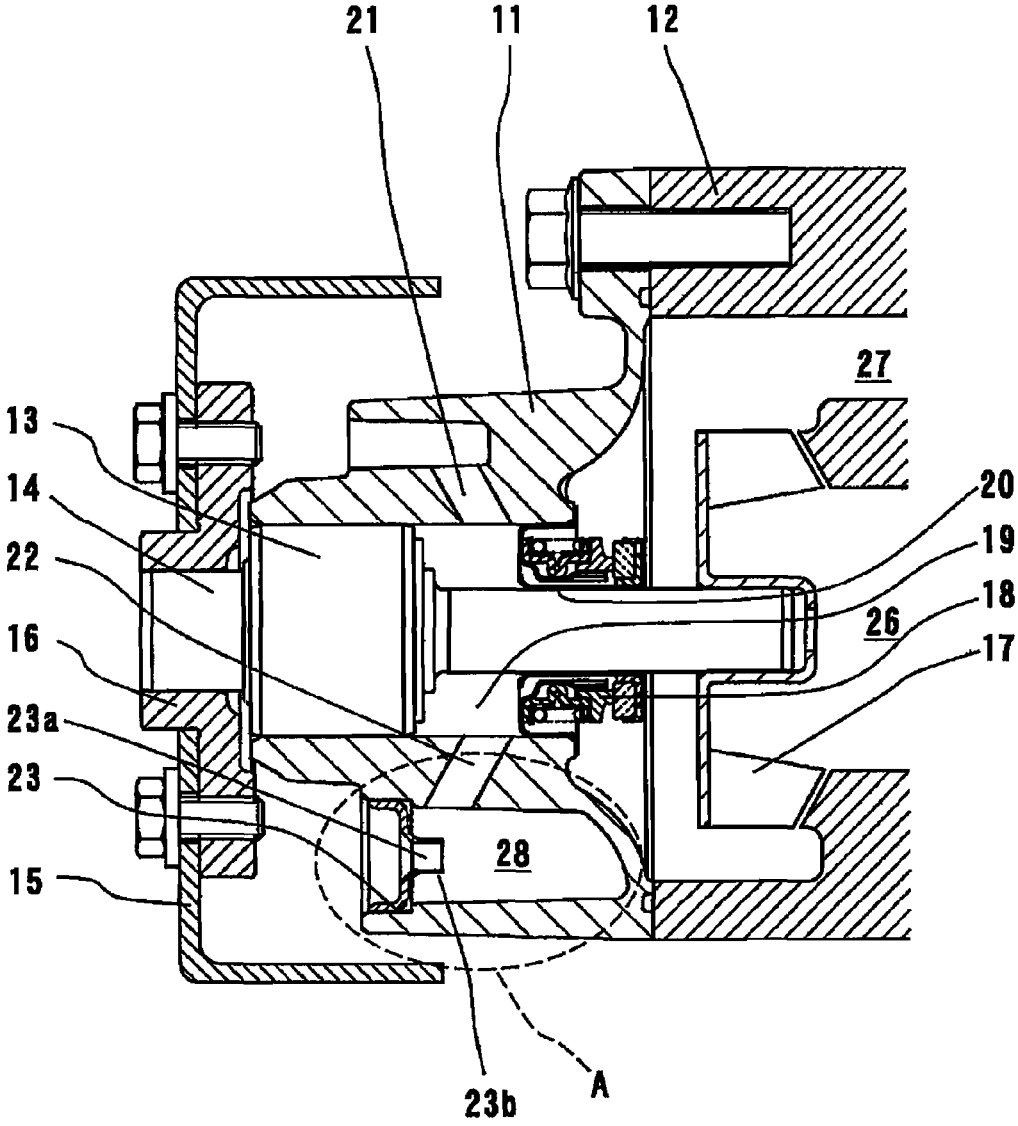
FIG. 1 is a cross-sectional view of a water pump according to a first embodiment of the present invention.
Figure 2:
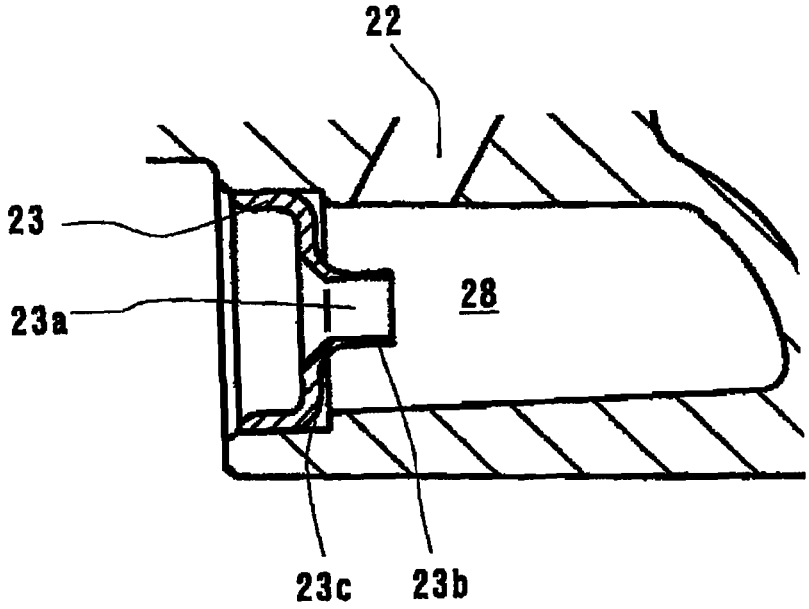
FIG. 2 is a magnified view of portion A in FIG. 1 showing a plug according to the first embodiment of the present invention.

As shown in FIG. 1, a body 11 is fixed to a cylinder block 12 by means of fixing members (e.g., bolts), and a rotational shaft 14 is supported by the body 11 via a bearing 13. A drive pulley 15 is fixed to a first end of the rotational shaft 14 via a pulley bracket 16 by means of fixing members (e.g., bolts), and an impeller 17 is secured to a second end of the rotational shaft 14 by press-fitting, so that the impeller 17 rotates by a rotation of the rotational shaft 14. An annular mechanical seal 18 is provided between the impeller 17 and the bearing 13. A space 19 is formed between the mechanical seal 18 and the bearing 13. There is a minor gap 20, between the mechanical seal 18 and the rotational shaft 14, which communicates with the space 19, and vaporized leaked water infiltrates the space 19 via the minor gap 20 from an impeller side where cooling water flows.

The body 11 includes a vapor-exhausting hole 21 which allows vaporized water to be released in an obliquely upward direction, and a draining hole 22 which allows condensed water drops to drain in an obliquely downward direction. The draining hole 22 is in communication with a reservoir 28 which is formed below the space 19 at a bottom portion of the body 11 in parallel to the rotational shaft 14.

The reservoir 28 is a space having a predetermined volume and opening within the drive pulley 15 at a side portion of the body 11 which is at an opposite side of the impeller 17 relative to the body 11, and is formed by plugging an opening portion (i.e., serving as a side opening) with a plug (i.e., serving as a plugging member) 23.

The plug 23 is liquid-tightly provided at an opening portion of the body 11 by press-fitting, for example, and a vapor hole (i.e., serving as an opening portion) 23*a* which is in communication with the reservoir 28 and the atmosphere is formed in a central portion of the plug 23. The vapor hole 23*a* provided at the central portion of the plug 23 includes a cylindrical portion 23*b* which extends towards the reservoir 28.

An operation of the water pump will be explained as follows. With the construction of the water pump according to the first embodiment, in response to a rotation of an external drive source, the rotational shaft 14 is integrally driven by a rotation of a belt provided at the drive pulley 15. Upon the driving of the rotational shaft 14, the impeller 17 which rotates integrally with the rotational shaft 14 rotates, and cooling water to be supplied to each portions of an engine is sucked from a cooling water inlet 26 formed in the cylinder block 12 and is exhausted from a cooling water outlet 27 to be supplied to each portions of the engine.

In those circumstances, vaporized water infiltrates the space 19 via the gap 20 formed between the mechanical seal 18 and the rotational shaft 14, and the vaporized water is exhausted outside via the vapor-exhausting hole 21. In the meantime, condensed water drops from the vaporized state are introduced to the reservoir 28 via the draining hole 22 provided at the bottom, and up to a predetermined volume (i.e., capacity of the reservoir 28) of the water which corresponds to the level reaching the vapor hole 23*a* provided in the reservoir 28 is stored in the reservoir 28.

With the foregoing construction, even when the water stored in the reservoir 28 rises upward at a minor gap 23*c* between the plug 23 and the body 11 by capillary action and water drops drip downward from an uppermost portion, the draining of the water to the atmosphere side is prevented by the cylindrical portion 23*b*.

Generally, an engine is in operation during the operation of the water pump, and the cylinder block 12 is under high temperature. Thus, the body 11 is under high temperature and the water stored in the reservoir 28 is vaporized and evaporated via the vapor hole 23*a*, and thus the water drop is not leaked from the reservoir 28 via the vapor hole 23*a*.

Configurations of the plug 23 may be varied as explained hereinafter.

Figure 3:
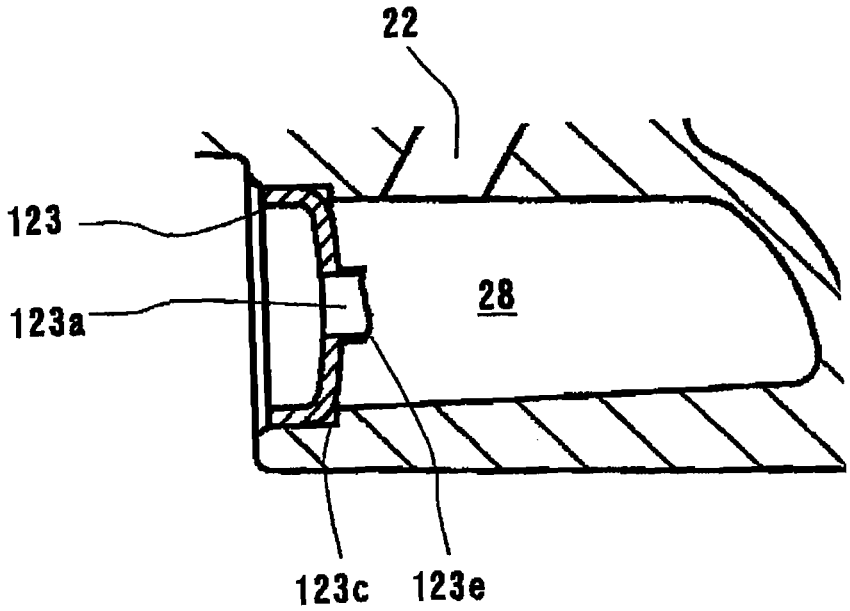
FIG. 3 is a magnified view of portion A in FIG. 1 showing a plug according to a second embodiment of the present invention.

According to a second embodiment, as shown in FIG. 3, instead of the cylindrical portion 23*b*, a burr 123*e* formed when machining a vapor hole 123*a* is utilized. Other constructions are common to the first embodiment, and explanations for the common constructions are not repeated.

Figure 4:
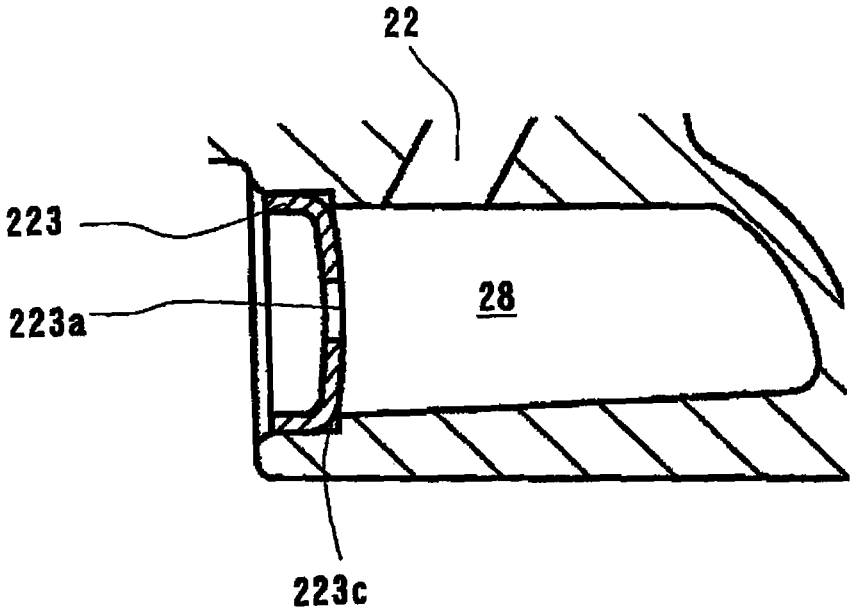
FIG. 4 is a magnified view of portion A in FIG. 1 showing a plug according to a third embodiment of the present invention.

According to a third embodiment, as shown in FIG. 4, a plug 223 is configured to protrude to the reservoir 28 side. Even when the water stored in the reservoir 28 rises upward at a minor gap 223*c* between the plug 23 and the body 11 by capillary action and the water drop drips downward from the uppermost portion, the water drips avoiding the vapor hole 23*a*. Other constructions are common to the first embodiment, and explanations for the common constructions are not repeated.

Figure 5:
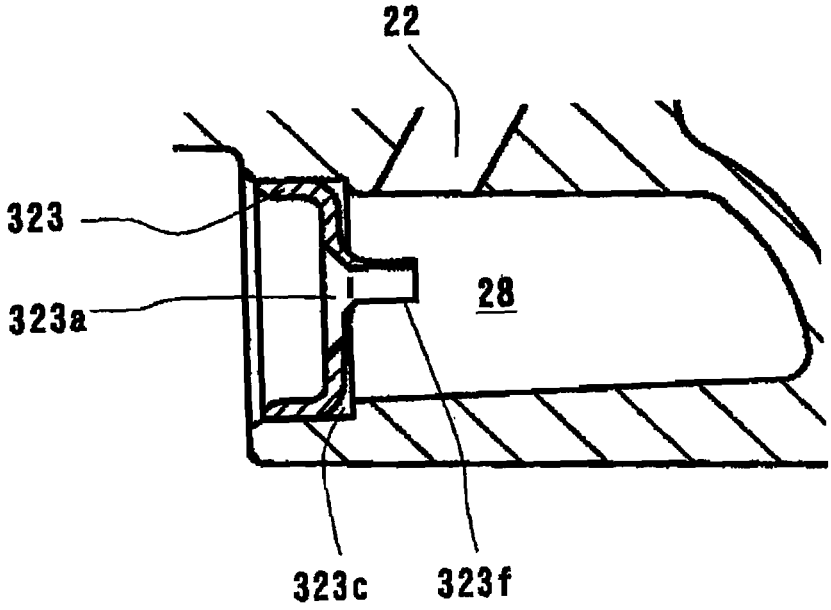
FIG. 5 is a magnified view of portion A in FIG. 1 showing a plug according to a fourth embodiment of the present invention.

According to a fourth embodiment, as shown in FIG. 5, an eave portion 323*f* may be provided using a top half of a cylindrical portion or a burr portion.

Further, by applying water repellent treatment on the plug 23, 123, 223, 323, of the embodiments, the capillary action is unlikely generated and the water drops are likely to drip downward even when the water rises upward by the capillary action.

According to the subject matter of the water pump, because the vapor hole 23*a* which establishes the communication between the reservoir 28 and the atmosphere side is provided at the plug 23 which liquid-tightly seals the reservoir 28, a predetermined volume of leaked water is securely stored in the reservoir 28, and particularly, the leaked water is prevented from flowing outside even when rising upward by capillary action at a minor gap between the plug 23 which closes the opening portion of the reservoir 28 and the body 11 to which the plug 23 is press-fitted.

According to the subject matter of the water pump, because the vapor hole 23*a* of the plug 23 is provided at the central portion of the plug 23, the leaked water is prevented from flowing outside even when the leaked water rises upward by the capillary action.

According to the subject matter of the water pump, because the vapor hole 23*a* of the plug 23 includes the cylindrical portion 23*b* facing the reservoir 28, the leaked water is prevented from flowing outside even when the leaked water raised upward by the capillary action is run from an upper portion of the plug 23.

According to the subject matter of the water pump, because the vapor hole 23*a* of the plug 23 includes the eave portion 23*f* facing the reservoir 28, the leaked water is prevented from flowing outside even when the leaked water raised upward by the capillary action is run from the upper portion of the plug 23.

According to the subject matter of the water pump, because the plug 23 is provided with the water repellent treatment, the water drips downward even when the leaked water raised upward by the capillary action is run from the upper portion of the plug 23, and accordingly, the leaked water is prevented from flowing outside.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A water pump, comprising:

a body;

an impeller provided at a first end of a rotational shaft supported by the body via a bearing;

a mechanical seal provided between the impeller and the bearing;

a draining hole introducing a water drop leaked from an impeller side via the mechanical seal to a reservoir provided at a bottom of the body and having a side opening;

a plugging member press-fitted in the side opening of the reservoir of the body for liquid-tightly sealing the reservoir;

a minor gap formed between the plugging member and the reservoir of the body, the minor gap being associated with capillary phenomena; and an opening portion provided at the plugging member for communicating the reservoir and an atmosphere side, wherein the opening portion is provided with a cylindrical portion at a reservoir side.

2. The water pump according to claim 1, wherein the opening portion is provided at a central portion of the plugging member.

3. The water pump according to claim 1, wherein the plugging member is provided with water repellent treatment.

4. A water pump, comprising:

a body;

an impeller provided at a first end of a rotational shaft supported by the body via a bearing;

a mechanical seal provided between the impeller and the bearing;

a draining hole introducing a water drop leaked from an impeller side via the mechanical seal to a reservoir provided at a bottom of the body and having a side opening;

a plugging member press-fitted in the side opening of the reservoir of the body for liquid-tightly sealing the reservoir;

a minor gap formed between the plugging member and the reservoir of the body, the minor gap being associated with capillary phenomena; and an opening portion provided at the plugging member for communicating the reservoir and an atmosphere side, wherein the opening portion is provided with an eave portion at a reservoir side.

5. The water pump according to claim 4, wherein the opening portion is provided at a central portion of the plugging member.

6. The water pump according to claim 4, wherein the plugging member is provided with water repellent treatment.

* * * * *